United States Patent [19]

Murphy

[11] 4,372,425

[45] Feb. 8, 1983

[54] AUXILIARY SCAFFOLDING ATTACHMENT

[76] Inventor: Michael Murphy, 234 Prospect Ave., Clifton Heights, Pa. 19018

[21] Appl. No.: 224,398

[22] Filed: Jan. 12, 1981

[51] Int. Cl.[3] ..... E04G 1/15; E04G 1/20

[52] U.S. Cl. ..... 182/179; 182/82; 182/222; 248/235

[58] Field of Search ..... 182/82, 179, 178, 222; 248/235, 250; 211/86, 90

[56] References Cited

U.S. PATENT DOCUMENTS

| | | | |
|---|---|---|---|
| 2,261,907 | 11/1941 | Uecker | 248/235 |
| 2,413,297 | 12/1946 | Deckert | 182/114 |
| 3,223,370 | 12/1965 | Pignon | 248/235 |
| 3,270,997 | 9/1966 | Gethmann | 182/82 |
| 3,493,208 | 2/1970 | Sato | 182/179 |
| 4,002,222 | 1/1977 | Bruno | 182/82 |

*Primary Examiner*—Reinaldo P. Machado
*Attorney, Agent, or Firm*—Jackson & Chovanes

[57] ABSTRACT

An auxiliary attachment for portable framework type of scaffolding assembly adapted for erection alongside a vertical face of a structure. The usual framework includes outwardly extended brackets to mount and support a horizontal worker platform formed of planking pieces. The auxiliary attachment of this invention is detachably and adjustably connectable to the front of the scaffold framework. A portion of the auxiliary attachment extends outwardly beyond the scaffold and provides support means for unsupported cantilever plank ends terminating adjacent a projection or abutment extending outwardly beyond the vertical structure face.

12 Claims, 8 Drawing Figures

AUXILIARY SCAFFOLDING ATTACHMENT

TECHNICAL FIELD

The present invention generally relates to scaffolding assemblies adapted for positionment along vertical walls of structures to support workers thereon. Known scaffolding assemblies, however, sometimes fail to provide adequate safety when the structure being worked on has discontinuities in the flat surface due to outwardly extended abutments. Such discontinuities can result in planks, forming a support, terminating in unsupported and unsafe ends, with resultant dangerous work areas. The present invention obviates this problem.

BACKGROUND OF THE INVENTION

Scaffolding assemblies or structures of a known type consist of a plurality of prefabricated sectionalized open framework portions. Such scaffolding assemblies are in widespread use, and are usually erected along faces of vertical surfaces being formed or worked upon.

The scaffolding includes worker platforms, or catwalks, to support workers as they move horizontally along the surface being worked upon. A common type of scaffolding currently in use consists of tubular sectional structures. The tubular scaffolding structure usually includes end sections in the nature of vertical frames, or arches, which are interconnected by beams and braces. Outwardly extending brackets are connected to the framework, adapted to mount and support a horizontal worker platform, or catwalk, formed of plural pieces of wood planking. The scaffolding can be erected to any desired length, and to any desired height, by joining together a plurality of interconnected vertical sections.

Such scaffolding structures usually consist of a plurality of portable sections which can be readily interconnected or detached from one another to form, or disassemble a scaffolding assembly of appropriate dimensions.

Scaffolding assemblies provide adequate worker support along surfaces of structures being worked upon, where the surfaces are not interrupted by outwardly extending projections, abutments and the like. Known scaffolding assemblies, however, fail to provide adequate safety when the surfaces or structures do have discontinuities in the flat surfaces in the nature of abutments or projections extending beyond the normal vertical face. Such discontinuities frequently result in ends of planks which are normally supported on the brackets, terminating in unsupported cantilever ends, with resultant dangerous work areas.

The present invention is primarily directed to a scaffolding assembly or structure which overcomes the aforementioned problem, and which provides overall appropriate worker support, even though discontinuities in the support planking are required because of projections or abutments extending beyond a vertical surface being worked upon.

While various attempts have been made to obviate this existing problem, no completely satisfactory answer has, to date, been provided. Some construction workers, and workers of other types, are therefore currently operating under hazardous work conditions. The present invention is directed to an improved scaffolding assembly, which incorporates auxiliary scaffolding attachments, which can be easily attached to existing scaffolding structures. The auxiliary attachments can be easily and readily moved horizontally along existing scaffolding structures, and can be so arranged and positioned as to provide adequate support for the above-mentioned cantilever, or unsupported, plank ends caused by discontinuities or interruptions in the surface being worked upon.

SUMMARY OF THE INVENTION

The present invention is broadly directed to scaffolding assemblies and, more specifically, to that type of scaffolding which consists of a portable framework adapted for erection alongside a face of a vertical structure being constructed or worked upon. The scaffolding assembly framework normally includes spaced vertical or arch-like frames, interconnected by horizontal beams, and the framework assembly has outwardly extending brackets connected thereto which are adapted to mount and support horizontal worker platforms, or catwalks, formed of a plurality of pieces of planking, or the like.

It is therefore a principal object of the present invention to improve scaffolding assemblies for worker safety when, due to the surface being worked on having discontinuities or interruptions therein, some of the worker support planks forming a catwalk are not wholly supported, but have cantilevered ends, where terminated due to a surface interruption.

The present invention fulfills this need in the art by means of an auxiliary attachment usable with known types of scaffolding structures such as shown, for example, in prior U.S. Pat. No. 3,493,208, dated Feb. 3, 1970, granted to Masataro Sato, which shows, broadly, a tubular component portable type of scaffolding.

The auxiliary attachment of the invention, which can be horizontally positioned as desired to support cantilever terminating plank ends, includes a horizontally extending cross-beam member, preferably of a ladder-like construction, which is detachably mounted to the front of the scaffold framework between adjacent vertical scaffolding frames. At least one, and preferably two or more, outward extending brackets, or outriggers, are positionally adjustably mounted on the cross-beam and extend outwardly therefrom. The cross-beam and brackets, as mounted, create an auxiliary support for plank ends terminating adjacent projections, or outward extensions in the nature of abutments and the like, beyond a vertical structural face being worked upon.

The construction and positionment of the auxiliary attachment is such that the auxiliary support for the planks will maintain all planks substantially level in the catwalk planking of the overall scaffolding assembly. This results in a continuous, fully supported work platform of substantially uniform height for a worker along the face of the vertical structure, extending proximate to interfering discontinuities or the like in the vertical face of the structure. Full worker support is provided around obstructions and since the auxiliary brackets are movable, obstructions in various positions can be accommodated.

Other objects and advantages of the present invention will become readily apparent to those skilled in the art from the following detailed description, wherein there is shown and described only a single preferred embodiment of the invention, simply by way of illustration of a best mode currently contemplated for carrying out the invention. As will be realized, the invention is capable of other and specific embodiments, and its several details are capable of modification in various, obvious respects, all without departing from the invention. Accordingly, the drawings and description are to be regarded merely as illustrative in nature, and not as restrictive.

BRIEF DESCRIPTION OF THE DRAWINGS

The accompanying drawings illustrated a preferred embodiment of the invention and, when taken together with the description, serve to explain the principles of the invention.

In the drawings.

DETAILED DESCRIPTION OF PREFERRED EMBODIMENT

Figure 1:
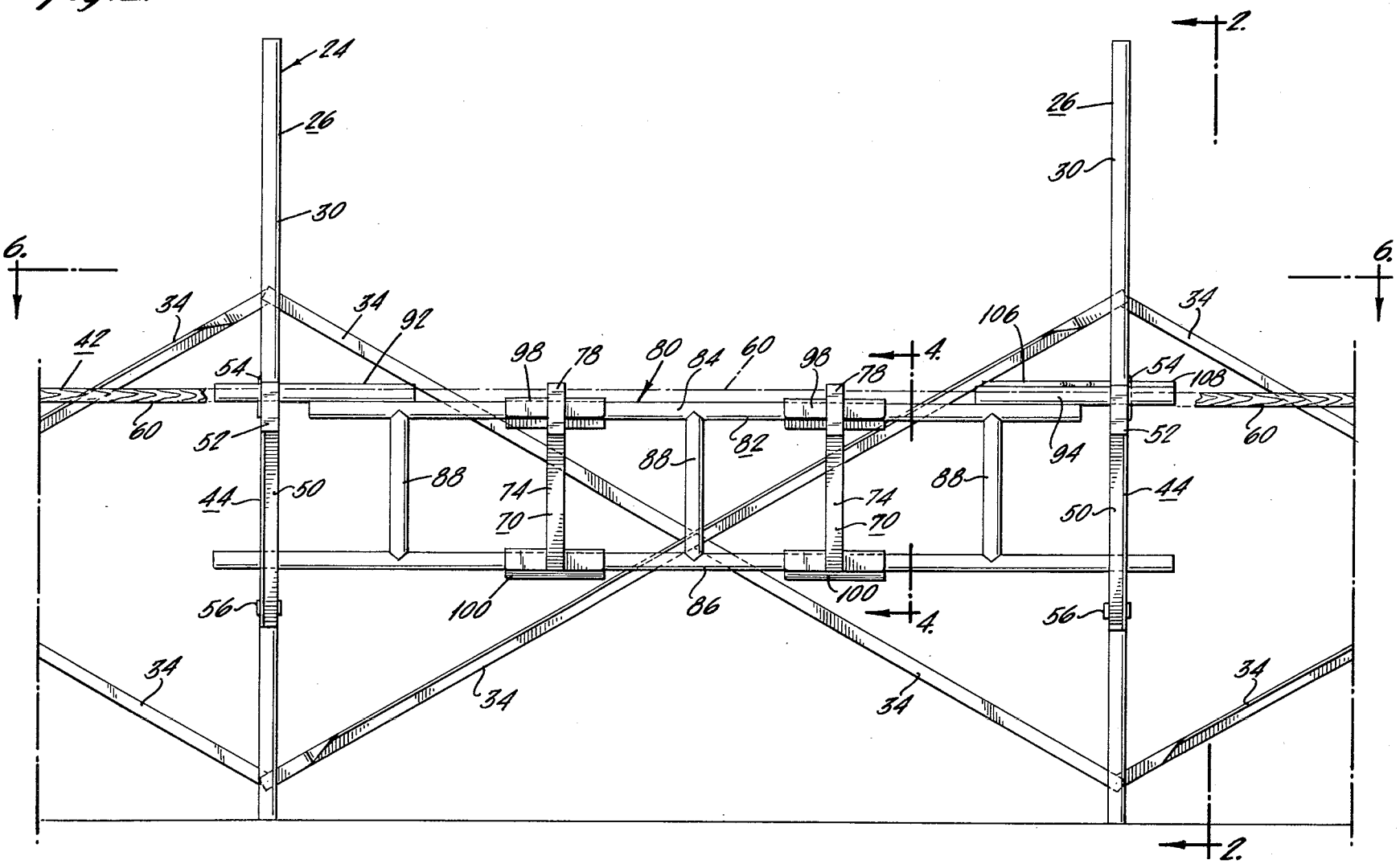
FIG. 1 is a composite elevational view, disclosing a prior art scaffold assembly, and with the auxiliary scaffolding attachment of the present invention mounted thereon.

In the drawings and in the accompanying detailed description of a preferred embodiment of the invention, only such portions of a prior art scaffold as is necessary to an understanding of the invention is set forth.

Figure 7:
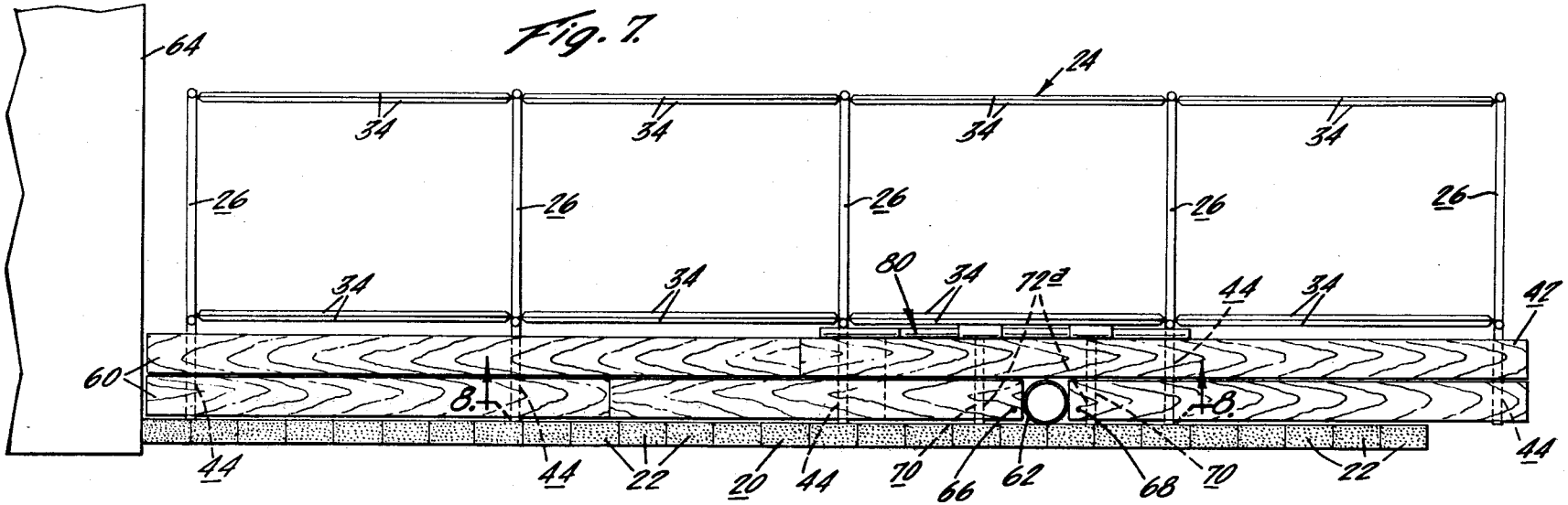
FIG. 7 is a schematic plan view of a portable scaffolding assembly, illustrating one type of problem which can be encountered in a "block" or "brick" laying construction operation, such as constructing a vertical wall, and disclosing utilization of the present invention to overcome a problem encountered due to the presence of an obstruction externally of the wall face with a resultant unsafe cantilevered plank catwalk section.

The use of scaffolds in erecting vertical walls of structures is apparent from a study of FIG. 7. This figure discloses a wall, generally designated 20, consisting of a plurality of blocks, bricks, or the like 22, which are mounted and affixed to one another by bricklayers utilizing mortar, not shown. Such structures are well known in the art. The walls are normally of substantial vertical height and may constitute parts of buildings, walls, etc. As the vertical height of a wall increases, it is necessary to provide means for worker support, together with materials, in order to effectively continue construction of the wall. Scaffolds or scaffolding arrangements are used for this purpose.

Figure 2:
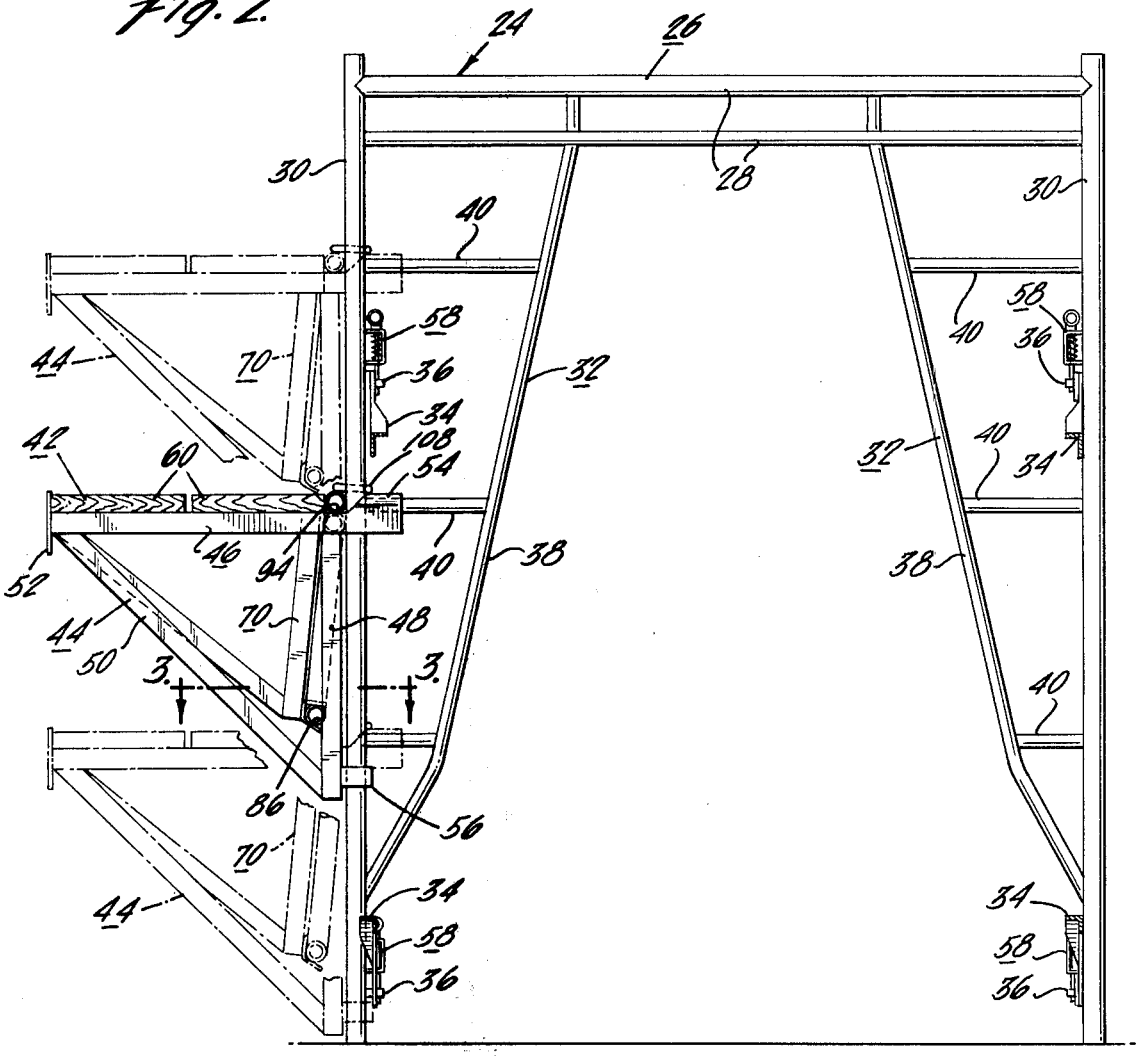
FIG. 2 is an elevational view of the composite structure, taken on line 2—2 of FIG. 1.
Figure 3:
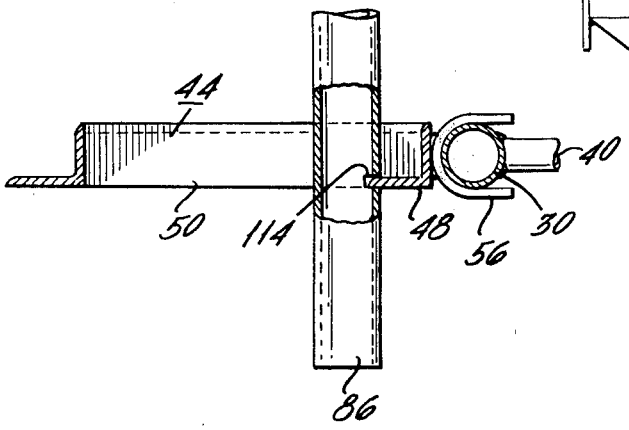
FIG. 3 is an enlarged, fragmentary sectional view taken along line 3—3 of FIG. 2.

In the drawings a scaffolding arrangement or construction is generally shown at 24 (see FIGS. 1, 2 and 7). The scaffold construction as depicted in the drawings is of a portable type composed of a plurality of tubular or other structural members which are interconnected by appropriate bracing or beams. The erected scaffold is placed adjacent to a vertical surface or face of a wall being constructed, as shown in FIG. 7.

A known type of prior art scaffold consists of a plurality of vertical frames or frame sections 26, composed of a plurality of horizontal tubes 28 interconnected with vertical tubes or members 30. Such vertical sections can additionally include bracing members, as generally shown at 32. In use, a plurality of vertical sections 26 are horizontally spaced along the face of walls being constructed, as shown in FIGS. 1 and 7. The individual vertical sections are disposed as uprights and are interconnected by crossbrace members 34. Interconnecting spring lock members, not shown in detail, can be provided at intersecting or interconnecting points 36. Obviously other interconnecting means such as pins, etc. can be utilized. The vertical sections 26 constitute main arches for formation of the shown scaffolding arrangement.

The bracing members 32 include generally diagonal and downwardly disposed tubes 38. At spaced intervals vertically therealong and between the vertical tubes 30, horizontal bracing and support tubes 40 are interconnected which, as will be pointed out hereinafter, also serve as connections and supports for brackets which serve to mount a worker platform or catwalk. These horizontal tubes 40 are, as shown in FIG. 2, positioned at vertically different levels of the vertical arch or vertical sections 26. Preferably the diagonal tubes 38, vertical tubes 30, horizontal tubes 28, horizontal support tubes 40, and their interconnections form the rigid main arches or vertical frame sections 26 for the scaffold and which, as pointed out above, are interconnected by means of the diagonal cross-braces 34.

As construction of wall 20 progresses, worker support means must be provided, and which are vertically elevated or positioned as the wall is vertically extended in construction. The worker support platforms or catwalks are generally shown in FIGS. 2 and 7 at 42. As shown in FIG. 2, they are placed at alternative heights as the structure being built progressively vertically rises. Each of the work support platforms 42 can be considered as a portion of an outrigger supported from a vertical face of the scaffolding. The specifics of such structures are well known in the art, and will be only broadly described and schematically shown herein.

The catwalks 42 generally include substantially triangular shaped brackets 44, which consist of horizontal legs or members 46, vertical legs or members 48, and angular diagonal bracing legs or members 50. These horizontal, vertical and diagonal leg members are preferably formed of angle irons in a known manner. The horizontal legs 46 have formed end vertical stops 52 in the nature of plates. The rearward ends of horizontal legs 46 have curvilinear shaped support brackets 54, which engage over the horizontal tubes 40 to serve as a partial support for the brackets 44. A rearwardly opening U-shaped member 56 is affixed proximate the lower rearward ends of vertical leg members 48, and engage around the vertical tubes 30 of the vertical sections. The combination of the brackets or supports 54, and U-shaped members 56, serve to engage with the scaffolding vertical members, and support the triangular shaped brackets thereon. As shown in FIG. 2, these brackets for supporting or comprising a portion of the outrigger or worker catwalk support can be vertically adjusted at alternative heights by engagement with various ones of the vertically spaced horizontal tubes 40, as building of the vertical wall progresses.

Pin and spring combinations, generally designated 58, can be used and serve for quick detachment of the various brackets and interconnected members in a known manner.

The foregoing described structure is of a type of generally known and presently used scaffolding. In use, the brackets 44, when attached to the vertical or main arch sections 26 of the scaffold, serve as supports for horizontally placed wooden planks 60, which are supported in a horizontal disposition by placement upon the upper and horizontal legs 46 of the triangular shaped brackets 44. When so placed, these planks constitute the catwalk 42, generally referred to hereinabove. The planks normally are of a rough and relatively thick and strong construction, and in actual use can have lengths in the neighborhood of fourteen feet. When arranged as shown in FIG. 7, these planks extend horizontally along the vertical face of the wall being constructed, and are supported by the brackets of the scaffolding arrangement or construction. The workers or bricklayers are safely supported on these catwalks and have freedom of movement along the horizontal extents or lengths of the wall being constructed. The catwalk also serves as a required support for materials being used by the workers to construct the wall, and further provide access for worker's aids to replace materials as used by the workers in constructing the wall. As well known, such additional materials can include additional bricks, interconnecting mortar, walkways for worker aids, etc.

Normally, scaffolds as shown and described can be placed along the vertical and horizontal extremities of the wall being constructed, and provide safe support for various personnel and workers involved in constructing the wall.

Under certain circumstances, however, the walls being built or constructed are interrupted by external projections or obstructions such as shown, for example, at 62 in FIG. 7, and/or adjacent buildings 64, angularly disposed walls, chimneys or the like. While normally the scaffolding can be so arranged and erected as to accommodate the angular interruptions such as at 64, scaffolding arrangements have not heretofore provided adequate means for support of ends of platform forming planking which terminate adjacent to obstructions such as at 62. The ends of such planks of interrupted continuity are indicated at 66 and 68 in FIG. 7. These board or plank ends, under such circumstances as shown, are not so positioned as to be adequately supported from the vertical arches or braces of the scaffolding, and in effect constitute cantilever or unsupported plank or board ends. If a worker moves onto such unsupported plank or board ends 66, 68, adequate support for the worker is frequently not provided, and the worker is inadequately or unsafely supported. This circumstance might unobviously occur as a worker moves along the supporting catwalk or platform.

Attention is invited at this point to the function of the vertical stops or plates 52, shown in FIG. 2. The boards or planks 60 are generally of a predetermined width, and their placement as shown in FIG. 2 is such that the forward end is prevented from displacement over or beyond the forward end of the horizontal tube 40, while the rearward disposition of the boards is maintained by the vertical tubes 30. The spacing between the plates 52 and the tubes 30 accommodates the side-by-side relationship or placement on the brackets to form the catwalks.

Figure 4:
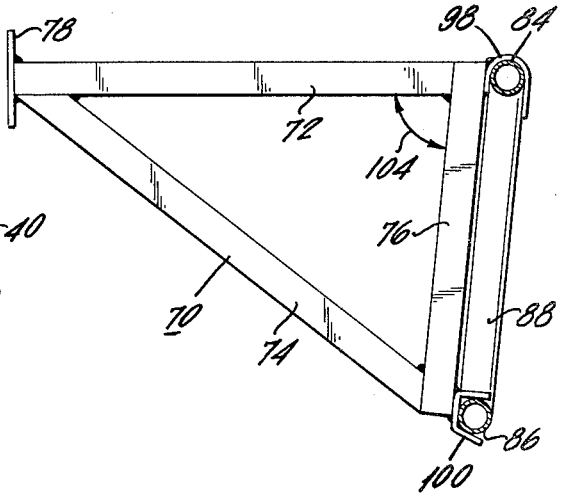
FIG. 4 is an enlarged sectional view, taken on line 4—4 of FIG. 1, disclosing in side elevation, mounting of an adjustable bracket or outrigger, and its support beam, in accordance with the invention, the auxiliary bracket being slidably attached to the horizontally extending support beam, the shown structure constituting the auxiliary scaffolding attachment.
Figure 8:
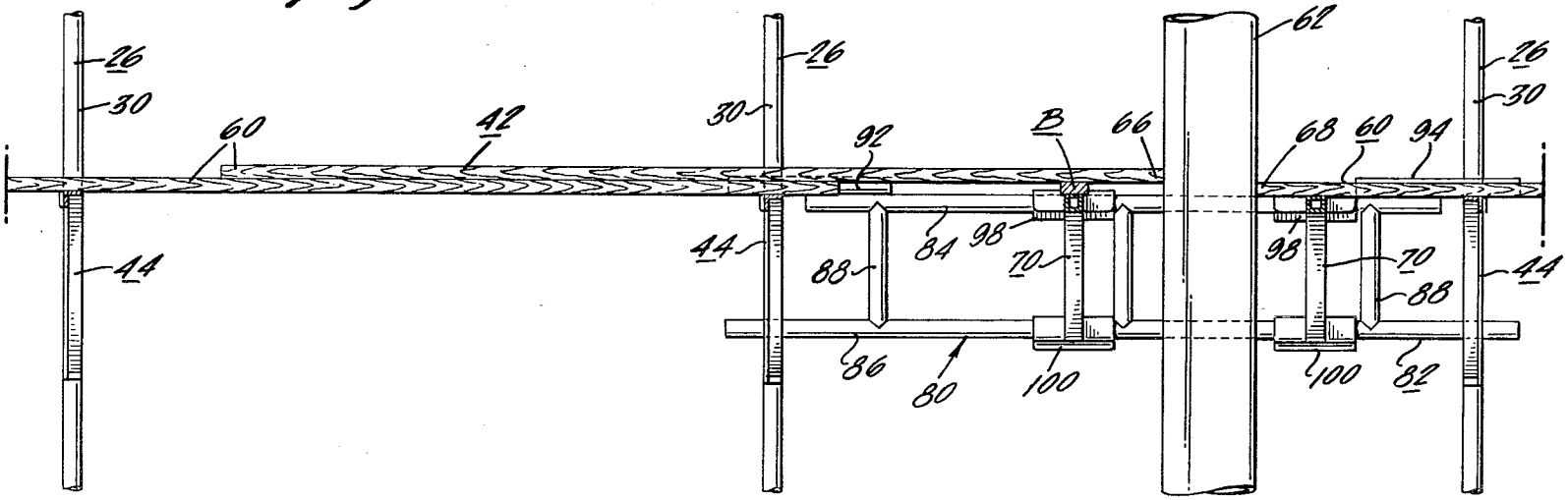
FIG. 8 is an enlarged, fragmentary, sectional elevational view taken on line 8—8 of FIG. 7, disclosing in greater detail positionment and use of the auxiliary scaffolding attachment of the present invention used for filling a void about an obstruction in the catwalk planks, to obviate an unsafe worker supporting condition, and exemplifying advantageous features and advantages of the present invention.

The auxiliary scaffolding attachment of the present invention is particularly devised to obviate or overcome difficulties arising due to the unsupported cantilevered ends of the planks or boards as indicated at 66 and 68 in FIG. 7. This relationship is also shown in FIG. 8 of the drawings. The auxiliary bracket of the present invention is generally shown at 70 in FIG. 4 of the drawings. It will be seen that the auxiliary bracket consists of a generally horizontal arm 72, an inclined brace arm 74 and a generally vertical arm or member 76. These three members conjointly form a substantially triangular shaped bracket. A forward stop plate 78 is mounted at the forward end of the bracket for the same function as the member 62, when the auxiliary bracket is in use.

Figure 5:
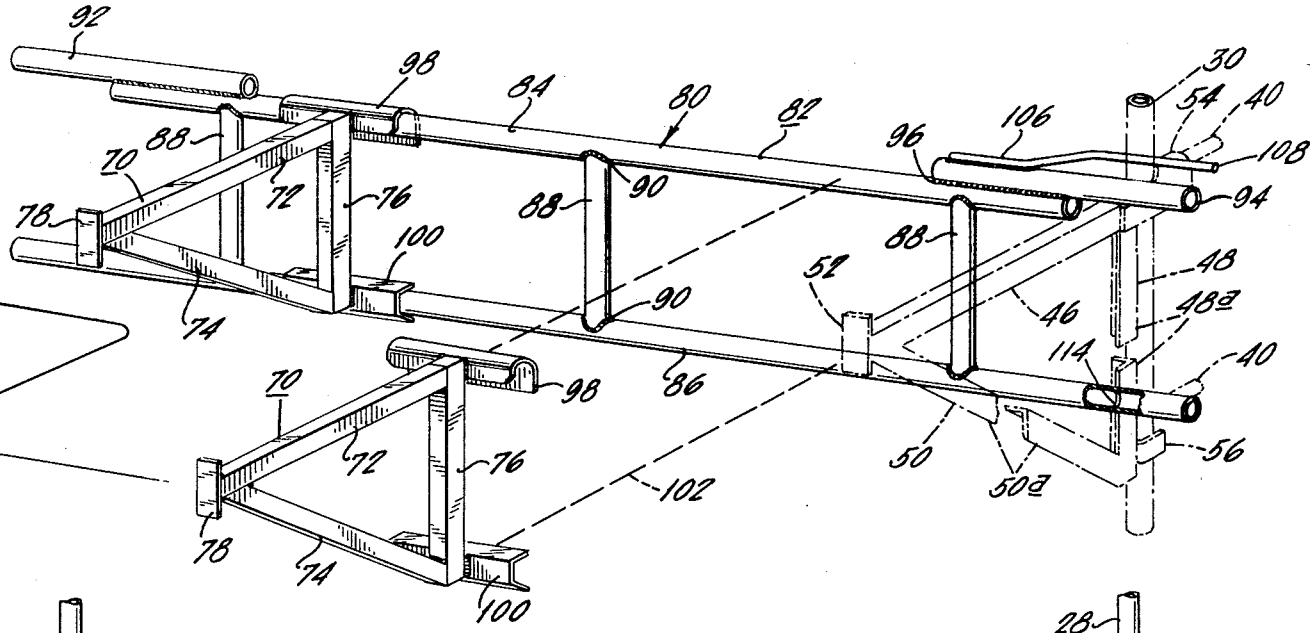
FIG. 5 is a perspective view, partly exploded, of the structural components of the present invention, with one of the slidably adjustable brackets or outrigger of FIG. 4 being shown in a position removed from the supporting cross-beam therefor and disclosing in greater detail mounting and securing means for one of the brackets of the invention.
Figure 6:
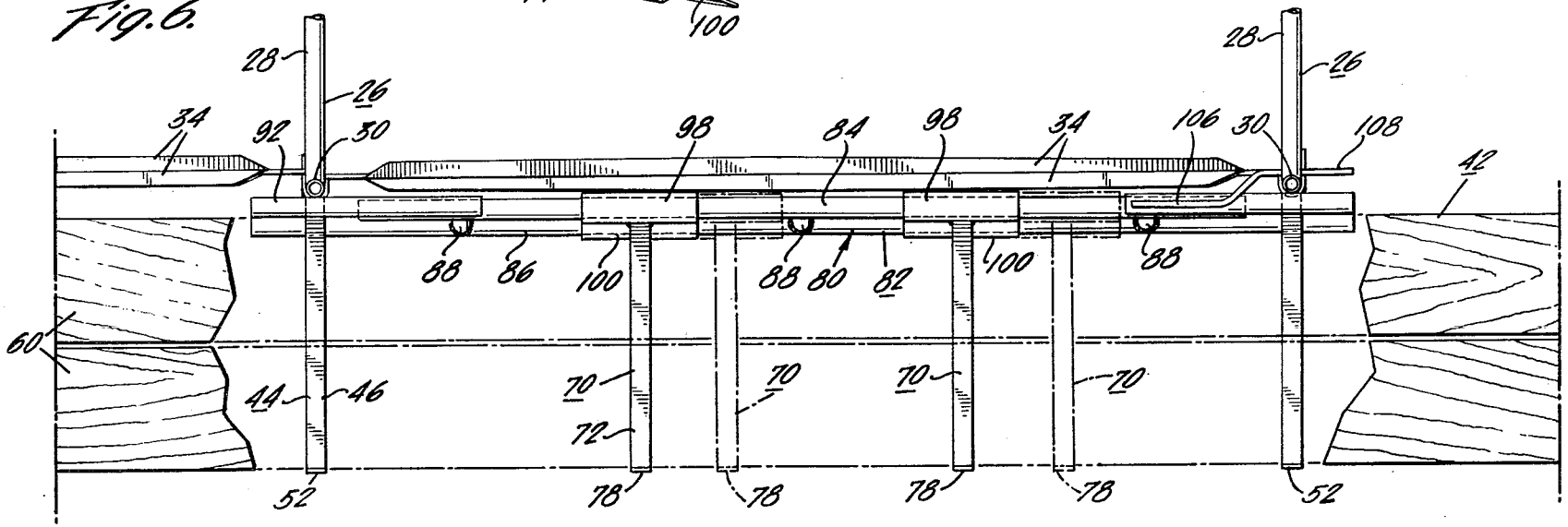
FIG. 6 is a fragmentary, plan view of a forward portion of the scaffolding assembly, taken on line 6—6 of FIG. 1, showing, in substantial detail, a catwalk assembly, outrigger support, and a displacedly mounted auxiliary attachment in accordance with the invention.

Reference is now made principally to FIGS. 1, 2, 4, 5 and 8 of the drawings, for a detailed showing of the hereinafter described structure constituting the auxiliary scaffolding attachment and brackets of the present invention. The general relationship of these members is shown in FIG. 7, where the auxiliary attachments 70 and brackets are shown in broken lines, disposed on opposite sides of the abutment or obstruction 62. The brackets positionally serve to support the otherwise unsupported cantilevered ends of the planks terminating, as at 66, 68 on opposite side of the obstruction. Referring particularly to FIGS. 5 and 6, it will be seen that the auxiliary scaffolding attachment, generally designated 80, which serves to operationally mount the auxiliary brackets 70 on, and with respect to, the main scaffolding has a unique structure to serve its function.

The scaffolding arrangement includes a cross beam member 82, of open type construction, and broadly is similar to a ladder. This cross beam has an upper longitudinal member or stringer 84, and a lower longitudinal member or stringer 86, each of which are analogous to the usual side members or legs of ladders. These stringers are interconnected by rungs or posts 88 in any desired manner, such as by welding at 90. It is noted that the upper member 84 is shorter than the member 86. Superposedly mounted on the upper member 84, at each end thereof are extensions 92, 94, secured in position by welding at 96 or the like.

The auxiliary brackets 70, in addition to the structure aforementioned, include an upper curvilinear interiorally shaped support bracket 98 of such dimension and configuration as to permit its mounting on the longitudinal stringer 84. These serve to support the upper portions of brackets 70. An angularly shaped lower support bracket 100 is attached to the lower end of the generally vertical arm member 76. This support bracket 100 is open-faced at the rear so that, following placement of the upper support 98 on the member 84, the lower support bracket 100 will engage with and around the lower longitudinal member or stringer 86. As so mounted and engaged by the support brackets 98, 100, the auxiliary bracket 70 is adjustably supported on the auxiliary scaffolding attachment 80, and can be longitudinally adjusted therealong to serve its function. One auxiliary bracket 70 is shown displaced from the attached position in dotted lines at 102, and which serves to clearly show how the auxiliary brackets can be attached to, or removed from, the auxiliary scaffold attachment 80.

The arrangement and function of the extensions 92 and 94 will now be explained. When an obstruction extends outwardly from a wall being worked upon, and it is desired to use the auxiliary attachment, the left or right end of the auxiliary scaffolding attachment is functionally mounted on adjacent ones of spaced vertical sections 26 as shown in FIG. 7. This is accomplished by sliding one of the extensions over one of the horizontal tubes 28, the lengths and attached positionments of the ends permitting this manipulation, and subsequently the opposite end can be slidably positioned over an adjacent horizontal tube 28 of an adjacent arch. The cross beam is permitted to rest upon and be supported on, and between, these horizontal members 28 of adjacent brackets. The lower longitudinal member 86 of the auxiliary attachment is then lowered onto contacting engagement with the outer face or surface of the vertical tube 30 of adjacent arches as shown in FIG. 5. The ends 92,94 are in resting engagement at the point of connection or intersection of horizontal leg 46 of a bracket 44 with the vertical tube or member 30, whereas the lower longitudinal member 86 rests against the outer face of vertical leg member 48 of the standard support bracket 42. It is for this reason that the horizontal arm 72 is disposed at an acute angle 104 to arm 76 (see FIG. 4) so that the upper surface of the arm 72 will be in a horizontal position when mounted upon the scaffold.

The mounting of auxiliary brackets in this manner permits a bracket to be so horizontally positionally stationed and attached to the scaffold as to underlie, and thereby support, the otherwise unsupported or cantilevered plank ends 66, 68. The supporting position can be seen from an inspection of FIG. 7, where the longitudinal upper arms of the auxiliary brackets, shown in dotted lines at 72A, underlie and support the board or plank ends on opposite sides of the obstruction 62. The longitudinal disposition of the supporting bracket arms insures a substantial uniformity in the level of all of the planks or boards constituting the catwalk. This insures, insofar as possible, safe working conditions for the worker. In the event that the plank or board lengths are such that they overlap, the board thicknesses are sufficiently small as to not create too great a discontinuity in the support, and if necessary, a block B can be inserted between the planks.

While normally the widths of the planks 60 maintain an appropriate positionment of one to another and of the auxiliary attachment to the scaffold, a positive locking means is optionally provided for. This may not be necessary but insures greater security of mounting and positionment of the auxiliary attachment. Reference is made to FIG. 5 of the drawings. A wire, rod, or the like member 106, is secured to the upper surface of the right end extension 94 and has an offset portion at 108. This rod with the offset, in conjunction with extension 94, serves to engage around the upright or vertical member 30 of one of the scaffold arches. The offset wire is hooked behind the vertical upright and prevents a displacement of the auxiliary attachment.

As previously mentioned, the scaffolding brackets 44 for the catwalk, in a usual scaffold, consist of angle irons such as more clearly shown in the right-hand portion of FIG. 5, where portions have been broken away at intermediate areas of the diagonal brace leg member at 50*a*, and the vertical leg member at 48*a*. This also shows a usual hook 110 of the bracket, which is placed behind the upright or vertical member 30 to positively position the scaffold bracket, and a lower attachment 112 engages around the vertical member 30 at the lower end of the bracket.

For additional security, a notch 114 is provided in the lower longitudinal member 84, and this engages over an edge of the angle-shaped vertical member of the bracket 44 and serves to resist a longitudinal displacement of the auxiliary bracket.

From the foregoing it will be seen that full worker support coverage is provided around obstructions, and the auxiliary scaffolding attachment can be so longitudinally positioned as to compensate for cantilevered or unsupported catwalk plank ends. The work surface is therefore provided without any substantial loss of continuity, and overcomes possibly hazardous conditions of unsupported plank ends.

The attachments, including the support means, are simple in form, generally lightweight, easily handled and readily mountable or attached to previously erected scaffolding structures. It is not necessary to utilize extraneous and/or additional tools to mount the auxiliary scaffolding attachment, and it is readily within the capability of normal workers familiar with scaffolding structures to mount the unit. The individual auxiliary support brackets are readily and easily horizontally movable to a position as may be required and, as pointed out, means are provided to prevent dislodgement of the various elements in use.

In this disclosure, there is shown and described a preferred embodiment of the invention, but as aforementioned, it is to be understood that minor modifications can be effected within the scope of the inventive concept as expressed herein, and as defined and limited solely by the appended claims.

I claim:

1. An auxiliary attachment for a scaffolding assembly alongside a vertical structure, said scaffolding assembly including outwardly extended brackets adapted for mounting and supporting a horizontal worker support platform, said auxiliary attachment being adjustably connected to said scaffold assembly, a portion of said auxiliary attachment extending outwardly beyond said scaffolding assembly in spaced relationship intermediate said spaced brackets, said auxiliary attachment including a detachable support and an auxiliary plank support bracket attached thereto and adapted to underlie and support an otherwise unsupported portion of a said worker support platform at a position spaced from a said extended scaffold worker support bracket.

2. An auxiliary attachment for a portable framework type of scaffolding assembly adapted for erection alongside a vertical structure, said framework scaffolding assembly including at least two horizontally spaced outwardly extended brackets adapted for mounting and supporting planks constituting a horizontal worker support platform, said auxiliary attachment being adjustably connected to said scaffold framework assembly, a portion of said auxiliary attachment extending outwardly beyond said scaffolding framework assembly and in spaced relationship intermediate said spaced brackets, said auxiliary attachment including a detachable support and an auxiliary plank support bracket adapted to underlie and support otherwise unsupported portions of a worker support platform at a position spaced from a said extended scaffold assembly worker support bracket.

3. An auxiliary scaffolding attachment selectively attachable to a principal scaffolding erected adjacent a vertical work surface, from which an interrupting projection extends outwardly therebeyond, the projection causing a discontinuity of the work surface and in a worker support catwalk, the catwalk consisting of a plurality of planks operationally supported on brackets extending from said principal scaffolding toward the work surface, the discontinuity in the arrangement of the planks forming the catwalk resulting in cantilever, unsupported plank ends proximate to the outwardly extended projection, said auxiliary scaffolding attachment including a detachable support attached to said principal scaffold intermediate adjacent plank support brackets thereof and supplemental plank support brackets horizontally adjustably attached to the said detachable support, said auxiliary attachment being mountable on principal scaffolding structure, and constituting adjustably positionable means adapted to underlie and support said cantilever, unsupported plank ends, to thereby provide a substantially continuous and safe worker support catwalk extending along the vertical work surface, and including the region thereof proximate to and extending around the interrupting outwardly extended projection.

4. An auxiliary attachment for a scaffolding assembly of a portable framework adapted for erection alongside a projection interrupted face of a vertical structure, wherein the scaffolding assembly framework includes spaced vertical archlike frames with vertical members and interconnecting horizontal beams, between said frames, the framework also including outwardly extended brackets connected to the framework and adapted to mount and support a horizontal worker catwalk formed of plural coacting planking pieces, said auxiliary attachment comprising a horizontally extending cross-beam member, detachably mountable to the front of the scaffolding assembly framework, with outer ends thereof extending beyond adjacent said vertical arch-like frames, said cross-beam member being positionally fixed against movement on, or dislodgement from, the scaffold framework, at least one horizontally positionally adjustable outrigger operationally mountable on said cross-beam and extending outwardly therefrom, said outrigger, as mounted, providing an auxiliary support for otherwise unsupported cantilever plank ends terminating adjacent the projection extending outwardly beyond the face of the vertical structure and supporting said ends at a substantially equal level with the catwalk planking of the scaffolding assembly, whereby a continuous fully supported work platform is provided for a worker along the face of the vertical structure, and extending so supported proximate the projection necessitating a discontinuity in the planking of the catwalk.

5. An auxiliary attachment for a scaffolding assembly of a type including an open framework of spaced vertical arches interconnected by horizontal beams and spaced catwalk forming plank support brackets extending from the framework, said auxiliary attachment being connectably mountable on said framework and comprising a horizontal cross-beam having upper and lower interconnected longitudinal members, said upper longitudinal member being shorter than said lower longitudinal member, extensions attached to the upper end sides of said upper longitudinal member, an auxiliary plank support bracket adjustably horizontally positionally mountable on said cross-beam and adapted to underlie and support portions of said catwalk forming planks spaced from said catwalk forming plank support brackets.

6. An auxiliary attachment as claimed in claim 5, said auxiliary plank support bracket comprising an open triangular shaped framework of structural members including a generally horizontal arm, a generally vertical arm connected to the top of said generally horizontal arm and an inclined bracing arm interconnecting the free ends of the other two said arms, said generally horizontal and vertical arms being disposed and interconnected to one another at an acute angle to compensate for a non-level generally horizontal arm position with said auxiliary attachment mounted on said scaffolding assembly.

7. An auxiliary attachment as claimed in claim 6, said attachment being mounted and supported on said framework by interposing said extensions on said upper longitudinal member behind vertical members of said vertical arches and superposed on horizontal members of said vertical arches, the lower of said longitudinal members of said cross-beam being in contacting positional engagement with said vertical member of said vertical arch below the point of mounting of the upper of said longitudinal members and thereby angularly disposing said cross-beam from a vertical position, the acute angular disposition between said generally vertical and horizontal arms of auxiliary bracket compensating for the aforesaid angular disposition of said cross-beam to thereby horizontally dispose said generally horizontal arm to properly support catwalk planks thereon.

8. An auxiliary attachment as claimed in claim 7, a downwardly opening, curvilinear shaped bracket support member on said auxiliary bracket at the juncture of said generally horizontal and vertical arms thereof adapted to engage on and over said upper longitudinal member of said cross-beam, and a rearwardly open angular shaped lower support member at the lower juncture end of said substantially vertical arm engageable with the lower longitudinal member of said cross-beam, said upper and lower support member constituting mounting means for said auxiliary plank support bracket on said cross-beam and operable to adjust the horizontal mounted position thereon.

9. An auxiliary attachment as claimed in claim 8, and including a rod-like member attached to one extension on said upper longitudinal member of said cross-beam, said rod-like member having an angular offset portion thereon in spaced relation to said extension, said offset portion and said extension being adapted for engaging therebetween a said vertical member of said vertical arch to constitute means to prevent dislodgement of said cross-beam in mounted position.

10. An auxiliary attachment as claimed in claim 9, including a vertical plank stop at the forward end of said auxiliary bracket to prevent plank displacement therefrom.

11. An auxiliary attachment as claimed in claim 9, said lower longitudinal member of said cross beam having a notch in the rearward side thereof engageable with a framework bracket structural member to prevent relative displacement of said cross beam and scaffolding assembly.

12. In combination, a scaffolding assembly having a plurality of horizontally spaced brackets extending therefrom adapted to support thereon planks forming worker support catwalks along a vertical work surface, and wherein an outward extending projection interrupts continuity of the catwalk whereby plank ends terminate between said brackets in an unsupported condition, means for supporting said unsupported plank ends consisting of a horizontally positionally adjustable auxiliary scaffolding attachment including a detachable support and a plank support bracket attached thereto and mounted intermediate said scaffolding brackets at points of plank end unsupported termination, and therebeneath, to insure continuity of catwalk support in the region about the interrupting projection.

* * * * *